US008649534B2

(12) United States Patent
Wu et al.

(10) Patent No.: US 8,649,534 B2
(45) Date of Patent: Feb. 11, 2014

(54) AUDIO INTERFACE DEVICE AND METHOD

(75) Inventors: Li-Te Wu, Taipei (TW); Wei-Chan Hsu, Cupertino, CA (US)

(73) Assignee: Fortemedia, Inc., Sunnyvale, CA (US)

( * ) Notice: Subject to any disclaimer, the term of this patent is extended or adjusted under 35 U.S.C. 154(b) by 29 days.

(21) Appl. No.: 13/409,807

(22) Filed: Mar. 1, 2012

(65) Prior Publication Data

US 2012/0163634 A1 Jun. 28, 2012

Related U.S. Application Data

(62) Division of application No. 11/755,043, filed on May 30, 2007.

(51) Int. Cl.
*H04R 3/00* (2006.01)

(52) U.S. Cl.
USPC ..... 381/113; 381/111; 381/122; 381/91; 700/94

(58) Field of Classification Search
USPC ..... 700/94; 381/111, 113–115, 122, 92, 91, 381/77
See application file for complete search history.

(56) References Cited

U.S. PATENT DOCUMENTS 6,757,398 B2 6/2004 Foley
7,241,179 B2 * 7/2007 Chennakeshu ..... 439/668
7,356,151 B2 4/2008 Seknicka
7,856,283 B2 12/2010 Burk et al.
7,961,895 B2 * 6/2011 Wu et al. ..... 381/81
2003/0021390 A1 1/2003 Delbecq et al.
2006/0215856 A1 9/2006 Meyer et al.
2008/0285776 A1 11/2008 Wu et al.

FOREIGN PATENT DOCUMENTS

TW 595239 6/2004

OTHER PUBLICATIONS

Taiwanese language office action dated Jan. 16, 2012.
English language translation of abstract of TW 595239 (published Jun. 21, 2004).
Bajdechi, O., et al. "A 1.8-V (delta sigma) Modulator Interface for an Electret Microphone with On-Chip Reference;" IEEE Journal of Solid-State Circuits; vol. 37; No. 3; Mar. 2002; pp. 279-285.

* cited by examiner

*Primary Examiner* — Xu Mei
(74) *Attorney, Agent, or Firm* — McClure, Qualey & Rodack, LLP

(57) ABSTRACT

The invention provides an audio interface device and method utilizing a single audio jack connector for plugging into a three-wire analog microphone or a three-wire digital microphone, thereby reducing dimensions and production costs thereof and an electronic system using the same. The audio interface comprises an audio jack connector, having first to third contacts electronically connected with the three-wire microphone plugged thereinto; and an audio processing device, detecting a type of the three-wire microphone plugged into the audio jack connector, outputting a clock signal to the three-wire microphone and receiving a digital audio signal from the three-wire microphone when the type is digital; or receiving analog audio signals from the three-wire microphone when the type is analog.

10 Claims, 3 Drawing Sheets

AUDIO INTERFACE DEVICE AND METHOD

CROSS REFERENCE TO RELATED APPLICATION

This application is a Divisional of co-pending application Ser. No. 11/755,043, filed on May 30, 2007, and for which priority is claimed under 35 U.S.C. §120, the entire contents of which are hereby incorporated by reference.

BACKGROUND OF THE INVENTION

1. Field of the Invention

The invention relates to audio interface, and in particular to an audio interface device and method to selectively connect a three-wire analog or digital microphone through a three-wire analog audio jack connector.

2. Description of the Related Art

An analog microphone has a three-wire audio plug, requiring a three-wire (or three-contact) audio jack connector, and a digital microphone generally has a four-wire audio plug, requiring a four-wire (or four-contact) audio jack connector. Conventionally, both the three-wire audio jack connector and the four-wire audio jack connector are simultaneously provided to an electronic system to meet requirements of either analog or digital microphone. Such configuration of audio jack connectors inevitably increases dimensions and production costs of the electronic system.

Accordingly, it is desirable to provide an audio interface requiring only a single connector for both analog and digital microphones.

BRIEF SUMMARY OF INVENTION

An exemplary embodiment of the invention is directed to an audio interface for three-wire microphone. The audio interface comprises an audio jack connector having first to third contacts electronically connected with the three-wire microphone plugged thereinto; and an audio processing device, detecting a type of the three-wire microphone plugged into the audio jack connector, outputting a clock signal to the three-wire microphone and receiving a digital audio signal from the three-wire microphone when the microphone is digital; or receiving analog audio signals from the three-wire microphone when the microphone is analog.

Further provided is a three-wire digital microphone for the disclosed audio interface. The three-wire digital microphone comprises a digital microphone circuit having a power terminal to receive a power signal, a clock terminal to receive the clock signal from the audio interface, a data terminal and a ground terminal; and a conversion device to convert the clock signal from the audio interface into the power signal for the power terminal. It is noted that the digital microphone circuit is activated by the power signal and the clock signal to output the digital audio signal through the data terminal to the second contact of the audio jack connector plugged into by the three-wire digital microphone.

Also provided is an interface method for a three-wire microphone. The interface method comprises providing an audio jack connector with first to third contacts electronically connected with the three-wire microphone plugged thereinto; detecting a type of the three-wire microphone plugged into the audio jack connector; and outputting a clock signal to the three-wire microphone and receiving a digital audio signal from the three-wire microphone when the microphone is digital, or receiving analog audio signals from the three-wire microphone when the microphone is analog.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
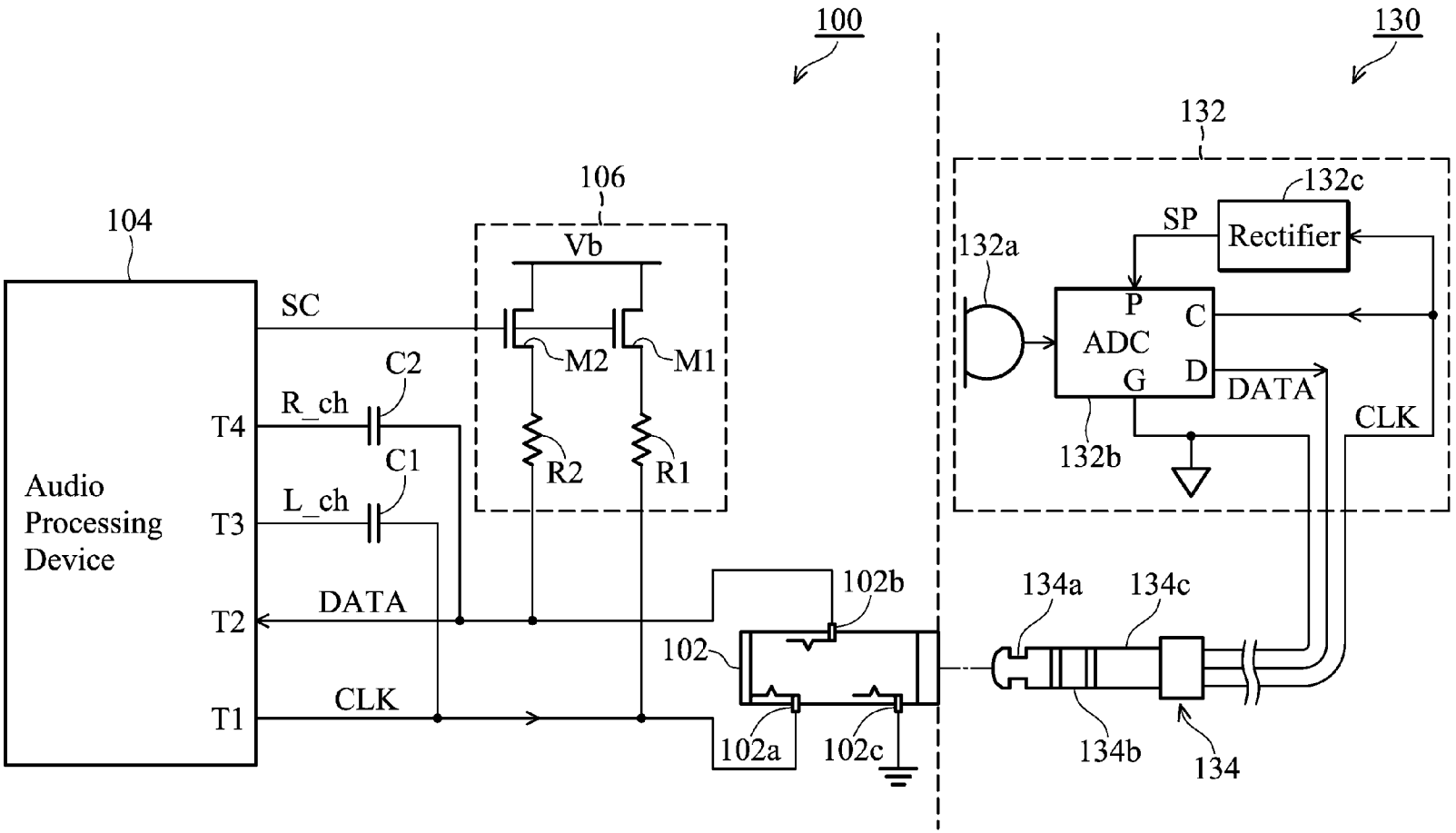
FIGS. 1 and 2 show an audio interface 100 for a three-wire microphone, according to a first exemplary embodiment of the invention.
Figure 2:
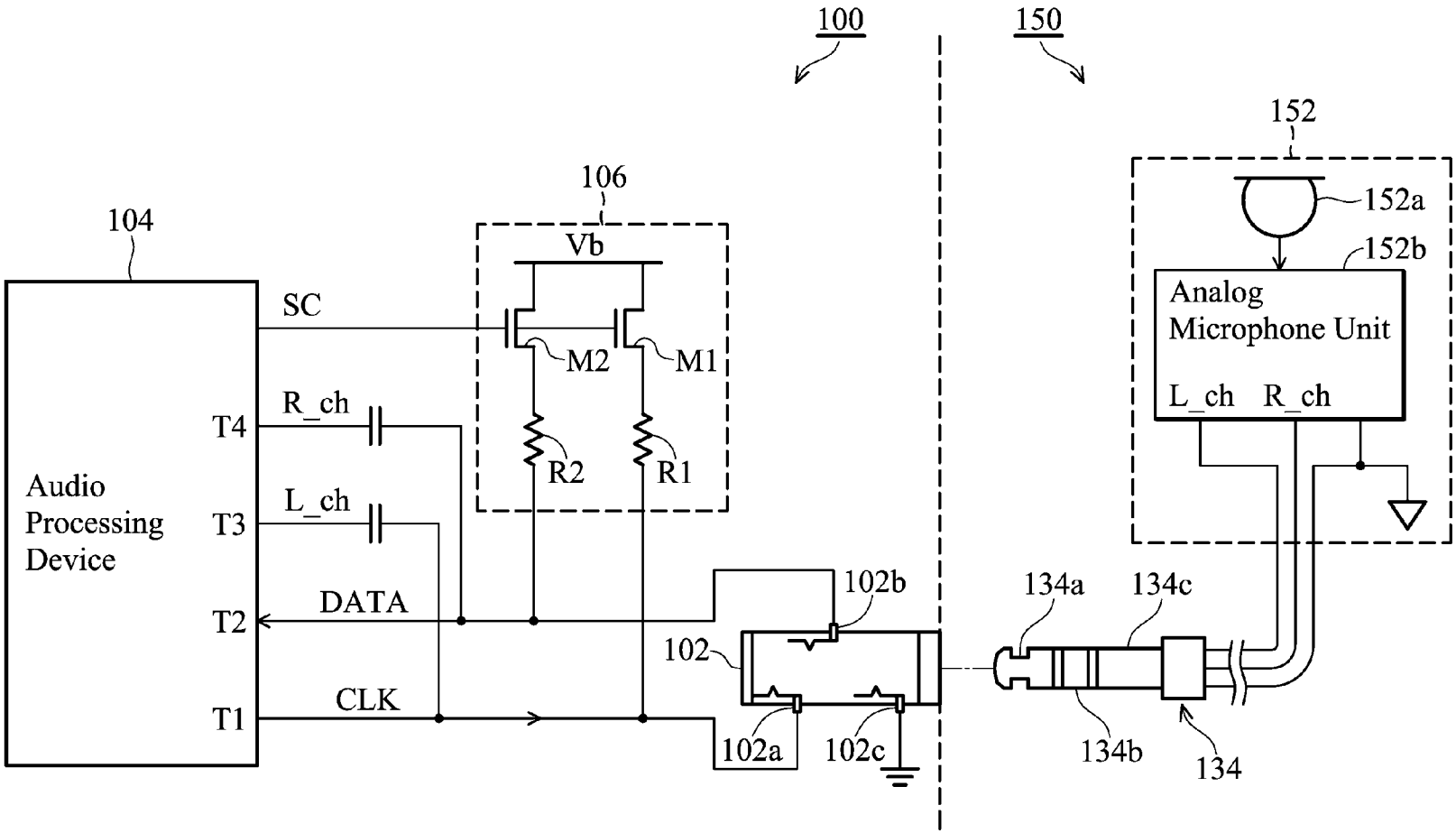

FIGS. 1 and 2 show an audio interface 100 for a three-wire microphone, according to an embodiment of the invention. In FIG. 1, the three-wire microphone 130 is a digital microphone. In FIG. 2 the three-wire microphone 150 is an analog microphone.

The audio interface 100 comprises an audio jack connector 102, an audio processing device 104 and a bias device 106. The audio jack connector 102 has first to third contacts 102*a*, 102*b* and 102*c* electronically connected with the three-wire microphone (130 or 150) plugged thereinto and the third contact 102*c* is connected to a reference ground. The audio jack connector 102 may be an analog audio jack connector of three wires (contacts).

In addition to receiving signals from the three-wire microphone 130 or 150, the audio processing device 104 also detects the type of the three-wire microphone plugged into the audio jack connector 102, and operates in response thereto. Referring to FIG. 1, when the microphone is digital, the audio processing device 104 outputs a clock signal CLK to the three-wire digital microphone 130, then receives a digital audio signal DATA from the three-wire digital microphone 130. Referring to FIG. 2, when the microphone is analog, the audio processing device 104 receives analog audio signals from the three-wire analog microphone 150 and drives the bias device 106 to bias the first and second contacts 102*a* and 102*b*.

The audio processing device 104 has a first terminal T1 connected to the first contact 102*a* to output the clock signal CLK, a second terminal T2 connected to the second contact 102*b* to receive the digital audio signal DATA, a third terminal T3 coupled to the first contact 102*a* through capacitor C1 to receive a left-channel signal L_ch of the analog audio signals, and a fourth terminal T4 coupled to the second contact 102*b* through capacitor C2 to receive a right-channel signal R_ch of the analog audio signals.

When the three-wire digital microphone 130, is plugged into the audio jack connector 102, the audio processing device 104 outputs a clock signal CLK from the first terminal T1 to activate the three-wire microphone 130 and subsequently receives a digital audio signal DATA from the three-wire digital microphone 130 through the second contact 102*b* to a second terminal T2. The audio processing device 104 further disables the bias device 106.

In FIG. 2, the three-wire analog microphone 150 may comprise an analog microphone circuit 152 and a plug unit 134 as depicted in FIG. 1. The analog microphone circuit 152 comprises a microphone unit 152*a* and an analog microphone unit 152*b* to convert the analog audio signals from the microphone unit 152*a* to the right-channel and left-channel signals R_ch and L_ch. When the three-wire analog microphone 150 is plugged into the audio jack connector 102, the audio processing device 104 merely receives the analog audio signals of the left-channel signal L_ch and right-channel signal R_ch from the three-wire analog microphone 150 through the first and second contacts 102*a* and 102*b* to the third and fourth terminals T3 and T4 respectively. The audio processing device 104 further drives the bias device 106 to bias the first and second contacts 102*a* and 102*b*. Also, the audio processing device 104 disables the first and second terminals T1 and T2, for example by setting T1 and T2 to high impedance states.

An exemplary embodiment of a three-wire digital microphone applicable with the disclosed audio interface is also provided. Referring to FIG. 1, the three-wire digital microphone 130 comprises a microphone unit 132 and a plug unit 134. The microphone unit 132 comprises a microphone 132*a*, a digital microphone circuit 132*b* to convert an analog audio signal from the microphone 132*a* into the digital audio signal DATA, and a conversion device 132*c* to convert the clock signal CLK from the audio interface 100 into a power signal SP for the digital microphone circuit 132*b*.

The conversion device 132*c* such as a rectifier receives and rectifies the clock signal CLK to generate a DC voltage as the power signal SP. The rectifier can be implemented by half-bridge, full-bridge rectifiers and the likes which can convert AC signal to DC signal.

The digital microphone circuit 132*b* such as an analog-to-digital converter (ADC) has a power terminal to receive the power signal SP, a clock terminal to receive the clock signal CLK from the audio interface 100, a data terminal to output the digital audio signal DATA and a ground terminal connected to reference ground. The digital microphone circuit 132*b* is activated by the power signal SP and the clock signal CLK to output the digital audio signal DATA through the data terminal to the second contact 102*b* of the audio jack connector 102.

The plug unit 134 is a three-wire plug with a tip portion 134*a* connected to the clock terminal C, a ring portion 134*b* connected to the data terminal D and a sleeve portion 134*c* connected to the ground terminal G. The tip, ring and sleeve portions 134*a* to 134*c* respectively are electrically connected to the first, second and third contacts 102*a* to 102*c* of the audio jack connector 102 when the three-wire digital microphone 130 is plugged into the audio interface 100.

As shown in FIGS. 1 and 2, the bias device may be implemented by transistors M1 and M2 and resistors R1 and R2, but is not limited thereto. The audio processing device 104 may output a logic control signal SC signal to control the bias device. For example, the audio processing device 104 may output the control signal SC with logic "High" to turn on the transistors M1 and M2 (i.e., enables the bias device 106) such that bias voltage Vb is provided to the first and second terminals 102*a* and 102*b* when the three-wire microphone plugged into the audio interface 100 is analog type. Otherwise, the audio processing device 104 outputs the control signal SC with logic "Low" to turn off the transistors M1 and M2 thereby turning off the transistors M1 and M2 and disabling the bias device 106.

To detect type of the three-wire microphone plugged into the audio interface 100, the audio processing device 104 may first assume the microphone is digital, then output the clock signal CLK to the three-wire microphone and disables the bias device 106. Then, the audio processing device 104 awaits response of the digital audio signal DATA from the three-wire microphone. If the microphone is digital, the audio processing device 104 receives response of the digital audio signal DATA and functions accordingly. Otherwise, the audio processing device 104, not receiving an appropriate response of the digital audio signal DATA, enables the bias device 106 and sets the first and second terminals T1 and T2 to high impedance states, thereby receiving and processing analog audio signals form the three-wire analog microphone. It is noted that the type detection as described above is proposed as an example and the disclosure is not limited thereto.

Figure 3:
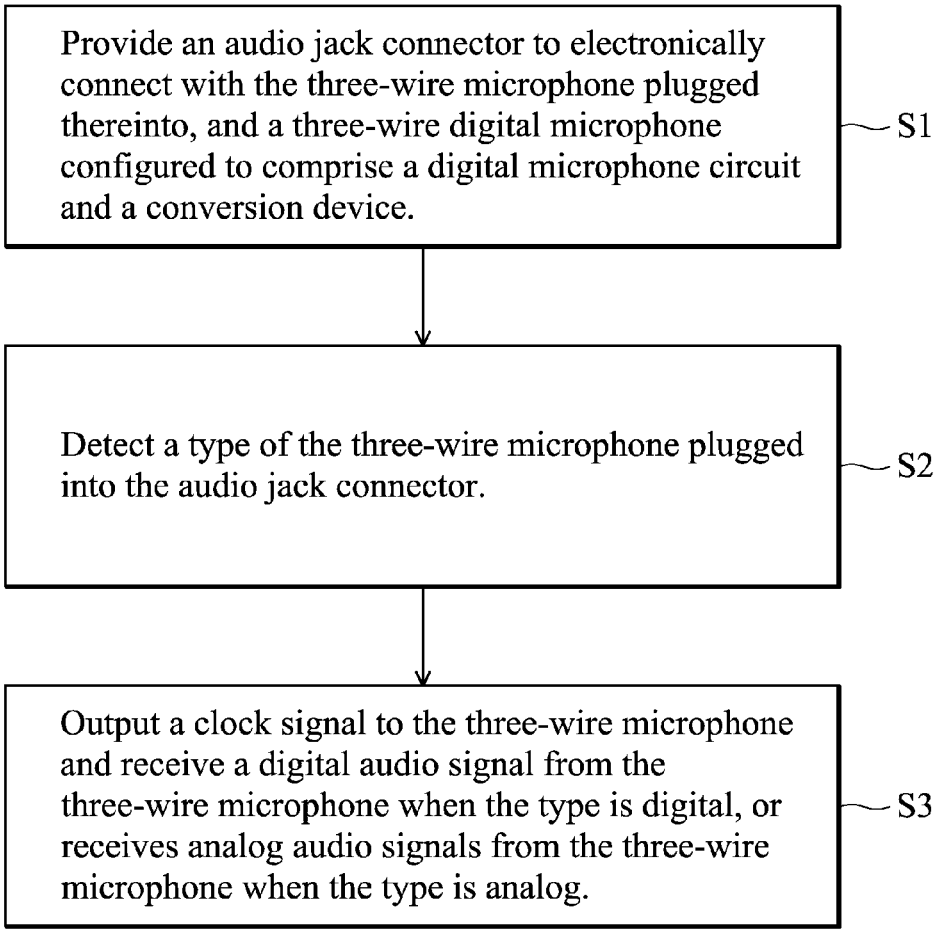
FIG. 3 is a flowchart of an audio interfacing method according to the invention.

FIG. 3 is a flowchart showing an audio interface method applying the disclosed audio interface, in which an audio jack connector is first provided to electronically connect with a three-wire microphone plugged thereinto, and further a three-wire digital microphone is configured to comprise a digital microphone circuit and a conversion device (Step S1). The type of the three-wire microphone plugged into the audio jack connector is determined (step S2). Finally, a clock signal is output to the three-wire microphone and a digital audio signal outputted from the three-wire microphone is received when the microphone is digital, or analog audio signals outputted from the three-wire microphone are received when the microphone is analog (Step S3).

In Step S1, the digital microphone circuit of the three-wire digital microphone comprises a power terminal to receive a power signal, a clock terminal to receive the clock signal from the audio interface, a data terminal and a ground terminal, activated by the power signal and the clock signal to output the digital audio signal through the data terminal to the second contact of the audio jack connector into which the three-wire digital microphone is connected. The three-wire digital microphone is also configured to comprise a three-wire plug with a tip portion connected to the clock terminal, a ring portion connected to the data terminal and a sleeve portion connected to the ground terminal. In addition, the conversion device converts the clock signal from the audio interface into the power signal for the power terminal.

The audio interface disclosed can use a common audio jack connector for plugging into a three-wire analog microphone or a three-wire digital microphone, and thus any electronic system such as notebook computer, cell phone, handheld devices, portable communication apparatus or other can utilize the audio interface to reduce dimension and production costs. Also, the three-wire digital microphone according to the disclosure described above has a simpler configuration than conventional four-wire digital microphone.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An audio interface for three-wire microphone, comprising:

an audio jack connector, having first to third contacts electronically connected with the three-wire microphone plugged thereinto; and an audio processing device, outputting a clock signal to the three-wire microphone based on the assumption that the three-wire microphone is digital, awaiting response from the three-wire microphone, wherein if the audio processing device receives a response it determines that the type of the three-wire microphone is digital, and determines that the type of the three-wire microphone is analog if no response is received.

2. The audio interface as claimed in claim 1, wherein the audio processing device has a first terminal connected to the first contact to output the clock signal, a second terminal connected to the second contact to receive the digital audio signal, a third terminal coupled to the first contact to receive a left-channel signal of the analog audio signals, and a fourth terminal coupled to the second contact to receive a right-channel signal of the analog audio signals; wherein the third contact is connected to a reference ground.

3. The audio interface as claimed in claim 2, further comprising a bias device to bias the first and second contacts when the type of the three-wire microphone plugged into the audio jack connector is analog.

4. The audio interface as claimed in claim 3, wherein when the type of the three-wire microphone plugged into the audio jack connector is analog, the audio processing device drives the bias device to bias the first and second contacts and disables the first and second terminals thereof.

5. The audio interface as claimed in claim 4, further comprising a first capacitor connected between the third terminal and the first contact, and a second capacitor connected between the fourth terminal and the second contact.

6. A three-wire digital microphone for the audio interface, wherein the audio interface is claimed in claim 1, comprising:

a digital microphone circuit having a power terminal to receive a power signal, a clock terminal to receive the clock signal from the audio interface, a data terminal and a ground terminal; wherein the digital microphone circuit is activated by the power signal and the clock signal to output the digital audio signal through the data terminal to the second contact of the audio jack connector plugged into by the three-wire digital microphone; and a conversion device converting the clock signal from the audio interface into the power signal for the power terminal.

7. The three-wire digital microphone as claimed in claim 6, wherein the conversion device is a rectifying device to rectify the clock signal to a DC voltage serving as the power signal.

8. The three-wire digital microphone as claimed in claim 6, further comprising a three-wire plug with a tip portion connected to the clock terminal, a ring portion connected to the data terminal and a sleeve portion connected to the ground terminal.

9. An interface method for a three-wire microphone, comprising:

providing an audio jack connector with first to third contacts electronically connected with the three-wire microphone plugged thereinto;

through an audio processing device, outputting a clock signal to the three-wire microphone based on the assumption that the three-wire microphone is digital and awaiting response;

determining the type of the three-wire microphone is digital if the audio processing device receives a response; and determining the type of the three-wire microphone is analog if no response is received by the audio processing device.

10. The interface method for a three-wire microphone as claimed in claim 9, wherein when determining the type of the three-wire microphone is analog, further biasing the three-wire microphone.

* * * * *